US005910812A

United States Patent [19]

Yamamoto et al.

[11] Patent Number: 5,910,812

[45] Date of Patent: Jun. 8, 1999

[54] TEXTILE PRINTING METHOD AND PRINTED TEXTILE OBTAINED THEREBY

[75] Inventors: Tomoya Yamamoto, Kawasaki; Masahiro Haruta, Tokyo; Shoji Koike, Yokohama; Koromo Shirota, Kawasaki; Aya Takaide, Yokohama; Mariko Suzuki, Kawasaki, all of Japan

[73] Assignee: Canon Kabushiki Kaisha, Tokyo, Japan

[21] Appl. No.: 08/499,654

[22] Filed: Jul. 7, 1995

[30] Foreign Application Priority Data

Jul. 21, 1994 [JP] Japan ..... 6-169435
Jan. 9, 1995 [JP] Japan ..... 7-001293

[51] Int. Cl.[6] ..... B41J 3/407

[52] U.S. Cl. ..... 347/106

[58] Field of Search ..... 347/93, 100, 103, 347/105, 106; 8/401, 441, 920

[56] References Cited

U.S. PATENT DOCUMENTS

| | | | |
|---|---|---|---|
| 5,356,437 | 10/1994 | Peterson et al. | 8/401 |
| 5,396,275 | 3/1995 | Koike et al. | 347/101 |
| 5,500,023 | 3/1996 | Koike et al. | 347/106 |
| 5,631,684 | 5/1997 | Takaide | 347/100 |

FOREIGN PATENT DOCUMENTS

| | | |
|---|---|---|
| 0 633 345 | 7/1993 | European Pat. Off. . |
| 0 655 527 | 11/1993 | European Pat. Off. . |
| 0 633 346 | 1/1995 | European Pat. Off. . |
| 0 633 347 | 1/1995 | European Pat. Off. . |
| 0 652 320 | 4/1995 | European Pat. Off. . |
| 54-59936 | 5/1979 | Japan . |
| 61-118477 | 6/1986 | Japan . |
| 62-39675 | 2/1987 | Japan . |
| 62-243890 | 10/1987 | Japan . |
| 5-295674 | 11/1993 | Japan . |
| 6-25576 | 2/1994 | Japan . |

*Primary Examiner*—Matthew Nguyen
*Attorney, Agent, or Firm*—Fitzpatrick, Cella, Harper & Scinto

[57] ABSTRACT

The present invention provides a textile printing method for forming a color mixture portion by partially overlapping at least three colors of inks including disperse dyes. In the printing method, the three color inks contain at least four disperse dyes in total.

10 Claims, 4 Drawing Sheets

TEXTILE PRINTING METHOD AND PRINTED TEXTILE OBTAINED THEREBY

BACKGROUND OF THE INVENTION

1. Field of the Invention

The present invention relates to a textile printing method using an ink-jet process, and a printed textile, and particularly to a method of printing on a cloth containing fibers which can be dyed with a disperse dye, and a printed textile.

2. Description of the Related Art

At present, the most common techniques for textile printing are screen printing and roller printing. These printing systems require platemaking and are unsuitable for diversified small-quantity production and cause difficulties for those trying to keep up with changes in fashion. There has recently arisen a demand for electronic textile printing systems which do not involve platemaking. To satisfy this demand, many textile printing methods using ink-jet recording have been proposed, and increasingly expected in many fields.

Requirements for ink-jet printing of cloth include the following:

(1) Providing a sufficient density for coloring;

(2) Achieving a high percentage of dye exhaustion and ease in waste water treatment following the washing process;

(3) Exhibiting less irregular bleeding due to mixture of different colors on cloth;

(4) Allowing a wide range of color reproduction; and (5) Offering recorded images having stable coloring properties.

Conventional measures to satisfy these requirements include the inclusion of various additives in the ink, controlling the amount of the ink ejected, pre-treating the cloth, etc.

As an ink-jet textile printing method for a cloth which is printed by using a disperse dye, e.g., a polyester cloth, Japanese Patent Laid-Open No. 61-118477 discloses a method which uses a disperse dye having a sublimation temperature of 180° C. or more. Printing using ink containing as a coloring material a disperse dye in consideration of only the sublimation temperature thereof exhibits good color development when inks are respectively used for dyeing. However, when inks are mixed on a cloth, after dyeing, the density, the tone and reproducibility of dyeing under the same dyeing conditions differs significantly according to the combination of the dyes used. Therefore, the above requirements (1), (4) and (5) are frequently not satisfied simultaneously. This method is therefore inadequate for allowing the expression of various colors.

It is impossible to fully satisfy the above various requirements, particularly requirement (5), using conventional techniques.

Ink-jet textile printing also was, heretofore, unlikely to give a sufficient density for deep colors such as blue or black. In particular, when a disperse dye is used, this problem is particularly important because the dye molecular structure is limited by the dyeing mechanism of a dye.

SUMMARY OF THE INVENTION

Accordingly, an object of the present invention is to solve the above-described problems of conventional ink-jet textile printing on a cloth mainly comprising fibers which can be dyed with a disperse dye, and provide a textile printing method and a printed textile obtained by the method, the textile being a clear printed textile having a high density, and a stable image showing no change in tone even if heating conditions for dyeing treatment are varied.

One embodiment of the present invention involves a method of printing on a cloth containing fibers employing a disperse dye in an ink-jet recording process that uses at least a first color ink, a second color ink, and a third color ink. These inks include a disperse dye, and the method involves (a) forming a color mixture portion by applying at least the first, second and third color inks to the cloth so that the first, second, and third color ink are partly overlapped. (b) fixing a dye to the cloth by heat treating the cloth on which the color mixture portion is formed, and (c) washing the cloth to remove at least a portion of any of the dye which has not been fixed from the cloth. The first, second, and third color inks contain a total of at least four disperse dyes.

Another aspect of this invention relates to printed textiles printed by the foregoing method, and also to a processed article made by processing the printed textile.

Finally, this invention also relates to a printed textile having a color mixture portion obtained by mixing colors of at least four disperse dyes, and having a hue within the range of $((a^*)^2+(b^*)^2)^{1/2}<10$, where chromaticity is indicated by a* and b* in accordance with CIE 1976 (L*, a*, b*).

DETAILED DESCRIPTION OF THE PREFERRED EMBODIMENTS

Figure 1:
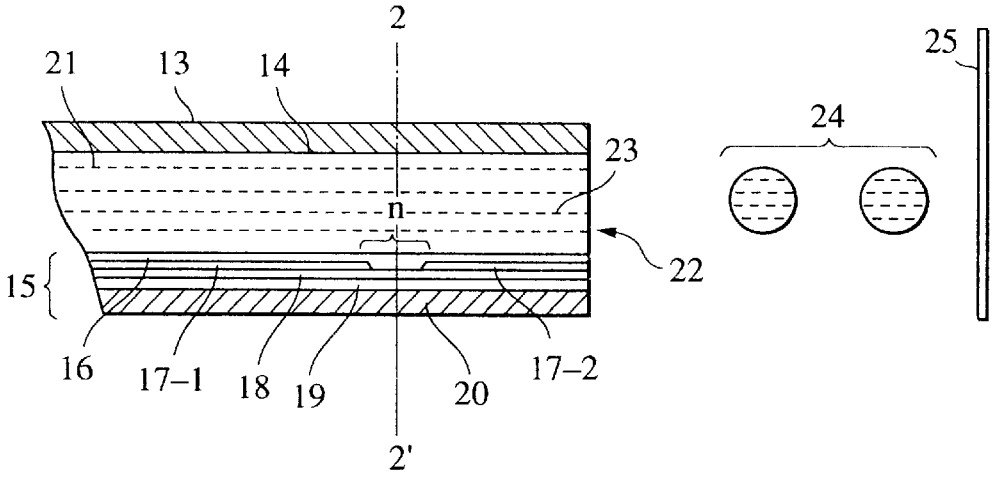
FIG. 1 is a side cross-sectional view showing a head portion of an ink-jet recording apparatus.

The present inventors conducted research for the purpose of satisfying all of the above performance requirements for an ink-jet textile printing method at the same time. As a result, it was found that build up property and hue stability in gradation expression are improved by using three color inks including at least disperse dyes, the inks containing at least four disperse dyes in total. It was also found that coloring properties are hardly changed even if reactive fixing conditions such as the temperature, time, etc. are varied, thereby providing a stable printed textile.

In ink-jet textile printing, since the viscosity of the ink used is very low, the amount of the dye adhered to a cloth is generally small in consideration of the mechanics of applying ink droplets thereto, in contrast conventional textile printing performed by screen printing. Since an infinite number of hues can be expressed using several types of inks, by changing the ratio of the ink dots ejected, the ejection order of inks and variations in cloth used significantly affect the coloring properties.

In regard to the build up property, since disperse dyes respectively exhibit dyeing amounts, the use of a plurality of dyes increases the dyeing amount, and a mixture of at least four dyes is particularly advantageous for improving the build up property which is an important problem of an ink-jet system.

When at least three color inks are used for forming a gradation, the hue can be finely adjusted by precisely varying the ratios of the inks ejected, thereby providing hue stability even if the lightness is changed.

In regard to coloring stability, it was further found that the effects of the ejection order of inks and the distribution state of dyes on a cloth on the coloring stability are decreased by increasing the number of dyes in a color mixture portion, and that the effects are rapidly increased by increasing the number of dyes to 4 or more.

Preferred Embodiments

The present invention will be described in further detail below with reference to preferred embodiments.

The cloth used in the present invention will now be described.

The material for the cloth used in the present invention contains fibers which can be dyed with a disperse dye. A cloth containing polyester, acetate or triacetate fibers is preferable, and the cloth containing polyester fibers is particularly preferred. The fibers can be provided as a woven fabric, knitted web, nonwoven fabric and so on.

Although such a cloth preferably contains 100% of fibers which can be dyed with a disperse dye, a mixed woven fabric or mixed nonwoven fabric containing fibers, which can be dyed with a disperse dye, and another material such as rayon, cotton, polyurethane, acrylic fibers, nylon, wool, silk or the like can also be used as a printing cloth for the present invention so long as the textile blend ratio is at least 30%, and preferably is at least 50%.

The size of the yarns which constitute the cloth is preferably within the range of 10 to 100 deniers. Although the size of the fibers which form the yarns is not limited, the present invention provides particularly beneficial results if the fiber size is 1 denier or less.

The ink-jet textile printing cloth preferably contains at least one substance selected from the group consisting of water-soluble metallic salts, water-soluble polymers, urea, thiourea and surfactants in an amount of 0.01 to 20% by weight relative to the dry weight of the cloth. The total content of these substances is preferably 0.5 to 18% by weight, and more preferably 1 to 15% by weight. With a content of less than 0.01% by weight, the addition of these substances has no effect. A content of more than 20% by weight is sometimes undesirable from the viewpoint of conveyance of the cloth.

Examples of water-soluble polymers include starch materials such as corn, wheat and the like; cellulose materials such as carboxymethyl cellulose, methyl cellulose, hydroxyethyl cellulose and the like; polysaccharides such as sodium alginate, gum arabic, locust bean gum, tragacanth gum, guar gum, tamarind seeds and the like; protein materials such as gelatin, casein and the like; natural water-soluble polymers such as tannin materials, lignin materials and the like. Examples of synthetic polymers include polyvinyl alcohol compounds, polyethylene oxide compounds, water-soluble acrylic polymers, water-soluble maleic anhydride polymers and the like. Of these polymers, polysaccharide polymers and cellulose polymers are preferred.

Examples of water-soluble metallic salts include compounds which form typical ionic crystals and have a pH of 4 to 10, such as halides of alkali metals and alkali earth metals. Typical examples of such compounds include alkali metal salts such as NaCl, $Na_2SO_4$, KCl, $CH_3COONa$ and the like; alkali earth metal salts such as $CaCl_2$, $MgCl_2$ and the like. Of these compounds, salts of Na, K and Ca are preferred.

The surfactant used is anionic, cationic, ampholytic or nonionic. Typical examples of such surfactants include anionic surfactants such as higher alcohol sulfates and sulfonates of naphthalene derivatives; cationic surfactants such as quaternary ammonium salts; ampholytic surfactants such as imidazoline derivatives; nonionic surfactants such as polyoxyethylene alkyl ethers, polyoxyethylene polyoxypropylene block polymers, sorbitan fatty acid esters, polyoxyethylene sorbitan fatty acid esters, ethylene oxide addition product of acetylene alcohol and the like.

The moisture regain of the cloth used in the present invention is within the range of 1.0 to 101.0%, preferably 3.0 to 81.0%. With a moisture regain of less than 1.0%, problems with respect to the coloring properties and the prevention of bleeding tend to occur. A moisture regain of more than 101.0% is sometimes undesirable from the viewpoints of the feeding properties and, particularly, bleeding.

The moisture regain of the cloth was measured in accordance with JIS-L-1019. Namely, 100 g of sample is carefully weighed, placed in a dryer at 105±2° C., and then dried therein until a constant weight is obtained. After water washing, the sample is again dried until a constant weight is obtained, and the weight of only the fiber portion after drying is measured. The moisture regain of the cloth is calculated by the following equation:

$$\text{Moisture regain } (\%)=\{(W-W')/W''\}\times 100$$

W: weight before drying, W': weight after drying, W": weight of fiber portion after water washing The ink used in the textile printing method of the present invention is an ink-jet textile printing ink comprising a disperse dye and a water-soluble liquid medium.

Preferable examples of disperse dyes include C.I. Disperse Yellow 5, 42, 54, 64, 79, 82, 83, 93, 99, 100, 119, 122, 124, 126, 160, 184:1, 186, 198, 199, 204, 211, 224 and 237; C.I. Disperse Orange 13, 29, 31:1, 33, 49, 54, 55, 66, 73, 118, 119 and 163; C.I. Disperse Red 54, 72, 73, 86, 88, 91, 92, 93, 111, 126, 127, 134, 135, 143, 145, 152, 154, 159, 164, 167:1, 177, 181, 204, 206, 207, 221, 239, 240, 258, 277, 278, 283, 288, 311, 323, 343, 348, 356 and 362; C.I. Disperse Violet 33; C.I. Disperse Blue 56, 60, 73, 79:1, 87, 87:1, 113, 128, 143, 148, 154, 158, 165, 15:1, 165:2, 176, 183, 185, 197, 198, 201, 214, 224, 225, 257, 266, 267, 287, 354, 358, 365 and 368; C.I. Disperse Green 6:1 and 9. However, a disperse dye is not limited to these dyes.

The content of the dye (when at least two dyes are combined, the total content) is 0.1 to 25% by weight, preferably 0.2 to 20% by weight, more preferably 0.3 to 15% by weight. When the content of a disperse dye is less than 0.1% by weight, the developed color may have an insufficient density. When the content of a disperse dye exceeds 25% by weight, the storage stability of ink deteriorates, or non-discharge of ink is likely to occur due to the thickening of deposit caused by ink evaporation in the vicinity of the nozzle tip.

A dispersant, a surfactant or a resin can also be used as a compound for dispersing a disperse dye in a water-soluble medium of the ink used in the present invention. Both anionic and nonionic dispersant or surfactant can be used. Examples of such compounds include anionic compounds such as fatty acid salts, alkyl sulfates, alkylbenzenesulfonates, alkylnaphthalenesulfonates, dialkyl sulfosuccinates, alkyl phosphates, naphthalenesulfonic acid-formalin condensation products, polyoxyethylene alkyl sulfonates, and substituted derivatives thereof; nonionic compounds such as polyoxyethylene alkyl ethers, polyoxyethylene alkyl phenyl ethers, polyoxyethylene fatty acid esters, sorbitan fatty acid esters, polyoxyethylene sorbitan fatty acid esters, polyoxyethylene alkylamine, glycerin fatty acid esters, polyoxyethylene polyoxypropylene block polymers and substituted derivatives thereof.

Examples of resin dispersants include block copolymers, random copolymers and graft copolymers and salts thereof comprising at least two monomers (at least one of which is a hydrophilic monomer) selected from styrene and derivatives thereof, vinylnaphthalene and derivatives thereof, aliphatic alcohol esters of $\alpha,\beta$-unsaturated carboxylic acids, fumaric acid and derivatives thereof, vinyl acetate, vinyl alcohol, vinyl pyrrolidone, acrylamide and derivatives thereof. These resins are preferably alkali-soluble resins which are soluble in aqueous solutions in which a base is dissolved.

The ink used in the present invention preferably contains water as a main component within the range of 10 to 93% by weight, preferably 25 to 87% by weight, and more preferably 30 to 82% by weight, relative to the total weight of the ink. The combination with a water-soluble organic solvent can make the effects of the invention significant. Examples of such solvents include monohydric alcohols such as methanol, ethanol, isopropyl alcohol and the like; ketones or keto alcohols such as acetone, diacetone alcohol and the like; ethers such as tetrahydrofuran, dioxane and the like; oxyethylene or oxypropylene addition polymers such as diethylene glycol, triethylene glycol, tetraethylene glycol, dipropylene glycol, tripropylene glycol, polyethylene glycol, polypropylene glycol and the like; alkylene glycols each having an alkylene group with 2 to 6 carbon atoms, such as ethylene glycol, propylene glycol, trimethylene glycol butylene glycol, hexylene glycol and the like; triols such as 1,2,6-hexanetriol and the like; thiodiglycol; bishydroxyethylsulfone; glycerin; lower dialkyl ethers of polyhydric alcohols such as ethylene glycol monomethyl (or ethyl) ether; diethylene glycol monomethyl (or ethyl) ether, triethylene glycol monomethyl (or ethyl) ether and the like; N-methyl-2-pyrrolidone; 2-pyrrolidone; 1,3-dimethyl-2-imidazolidinone and the like. The content of the water-soluble organic solvent is generally within the range of 0 to 50% by weight, and more preferably 2 to 45% by weight, relative to the total weight of the ink.

Although the above materials can be used singly or in a mixture, the most preferable liquid composition contains as the solvent at least one monohydric or polyhydric alcohol or a derivative thereof. Of these solvents, thiodiglycol, bishydroxyethylsulfone, diethylene glycol, triethylene glycol, triethylene glycol monomethyl ether, tetraethylene glycol monomethyl ether and ethanol are particularly preferred.

In addition to using the textile printing method of the present invention the ink components described above, other various additives such as a pH adjusting agent, a surfactant, a viscosity modifier, a surface tension modifier, a fluorescent whitening agent, etc. can be added, if needed.

The textile printing method of the present invention will be described below.

The present invention is characterized by using at least three color inks including disperse dyes, the inks containing at least four disperse dyes in total.

In the case when inks of two colors or less are used, it can be difficult to achieve fine control of a tone in gradation expression is difficult, and hue expression is significantly limited. In the case when the inks contain three or less disperse dyes in total, problems involving the build up property and coloring stability of the ink-jet system become significant.

The present invention significantly exhibits the effects in a deep color portion, and preferably satisfies the condition $((a^*)^2+(b^*)^2)^{1/2}<10$, more preferably $((a^*)^2+(b^*)^2)^{1/2}<8$, where chromaticity is indicated by (a*, b*) in CIE 1976 (L*, a*, b*).

In the formation of an image of a deep color, the use of color inks each of which contains at least two disperse dyes and which, after dyeing of a cloth with the single ink, shows the hue satisfying the condition $((a^*)^2+(b^*)^2)^{1/2}<10$, preferably $((a^*)^2+(b^*)^2)^{1/2}<8$, and more preferably $((a^*)^2+(b^*)^2)^{1/2}<5$, facilitates the fine control of the ink ejection order and of variations in conditions of the reactive fixing process, thereby further improving the coloring stability.

Any one of conventional known ink-jet recording systems can be used. For example, the most effective system is the ink-jet recording system disclosed in Japanese Patent Laid-Open No. 54-59936 in which ink is discharged from a nozzle by means of the action of the rapid change in state of the ink caused by the application of heat energy thereto. One explanation reason for this is that when a recording head having a plurality of nozzles is used, the above system exhibits small variations in the discharge speed of the ink from the nozzles, the discharge speed being within the range of 5 to 20 m/sec. When ink containing disperse dyes strikes the cloth at a speed within the above range, ink droplets penetrate into fibers in a manner which optimizes adhesion of ink to the fibers. When the ink used in the present invention, containing the above-described dyes, is used in such an ink-jet recording system, neither deposit of foreign materials on a heater nor disconnection occurs even when recording is continuously made for a long period of time, thereby enabling stable textile printing.

Effective conditions for the textile printing method of the present invention preferably include a droplet discharge amount of 20 to 200 pl, an amount of the ink ejected being 4 to 40 nl/mm$^2$, a drive frequency of at least 1.5 KHz, and a head temperature of 35 to 60° C.

An example of an apparatus suitable for textile printing using the present invention is an apparatus in which ink droplets are generated by applying heat energy to the ink contained in a chamber of a recording head according to a recording signal. This apparatus will be described below.

Figure 2:
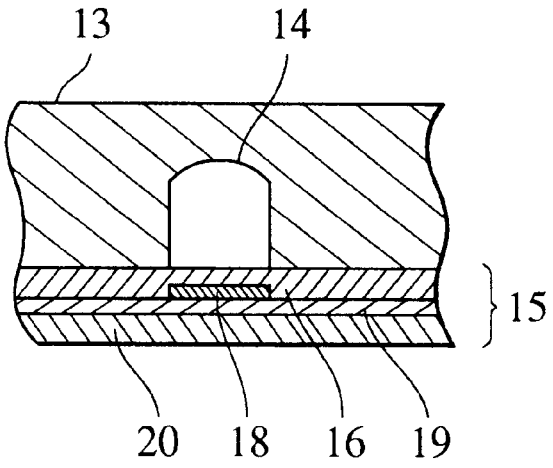
FIG. 2 is a front cross-sectional view showing a head portion of an ink-jet recording apparatus.
Figure 3:
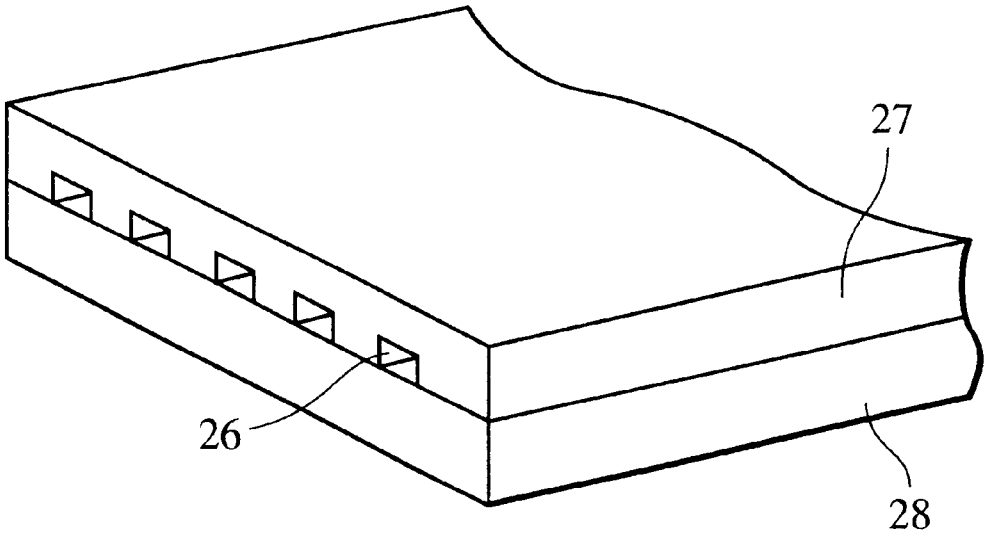
FIG. 3 is a perspective view showing a multi-head comprising the heads shown in FIG. 1.

FIGS. 1, 2 and 3 show examples of the construction of a head as a principal portion of the apparatus.

A head 13 comprises a glass, ceramic or plastic plate having a channel 14 for passing ink therethrough, and a heating assembly 15 (an assembly is shown in the drawings, but it is not limited to the use of such an assembly) used for heat-sensitive recording, both of which are bonded together. The heating assembly 15 comprises a protective film 16 consisting of silicon oxide or the like, aluminum electrodes 17-1 and 17-2, a heating resistor layer 18 consisting of nichrome or the like, a heat accumulating layer 19, and a substrate 20 consisting of aluminum exhibiting good heat radiation.

An ink 21 reaches a discharge orifice (a fine port) 22 and forms a meniscus 23 under pressure P.

When an electrical signal is supplied to the electrodes 17-1 and 17-2, area n of the heating head 15 rapidly generates heat, and bubbles are generated in the ink 21 which is in contact with area n. The meniscus 23 is caused to protrude outward by the pressure caused by the generation of bubbles so as to discharge the ink 21 and scatter the ink 21 as droplets 24 toward a cloth 25 containing fibers which can be dyed with a disperse dye. FIG. 3 shows the appearance of a multi-head in which a plurality of the heads 13 shown in FIG. 1 are arranged in a line. The multi-head is produced by bonding a glass plate 27 having multiple channels 26 and the same heating assembly 28 as that shown in FIG. 1. FIG. 1 is a sectional view of the head 13 taken along the ink passage, and FIG. 2 is a sectional view taken along line 2-2' of FIG. 1.

Figure 4:
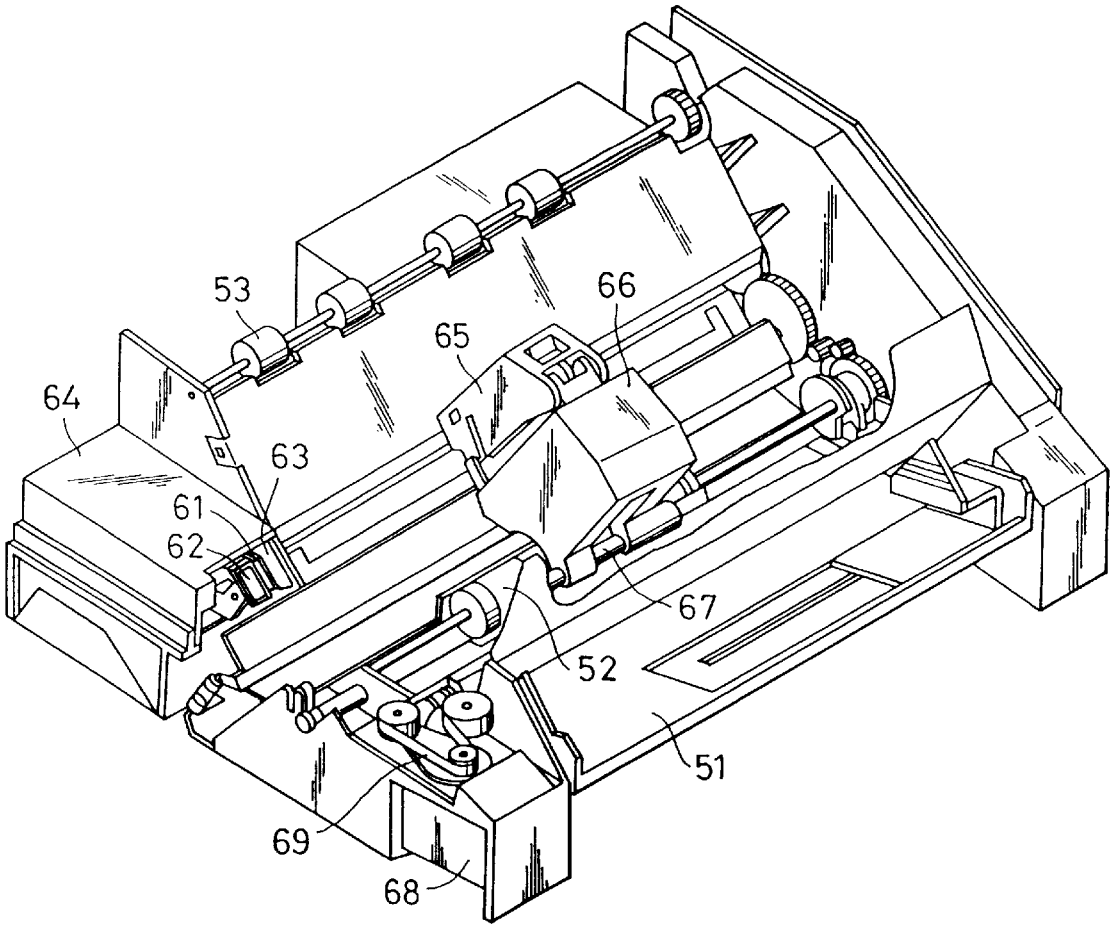
FIG. 4 is a perspective view showing an example of an ink-jet recording apparatus.

FIG. 4 shows an example of ink-jet recording apparatus including the above head.

In FIG. 4, reference numeral 61 denotes a cantilevered blade which serves as a wiping member, one end thereof being held by a blade holding member to serve as a fixed end. The blade 61 is disposed adjacent to an area where recording is performed by the recording head. In this example, the blade is held so as to project into the path of motion of the recording head. Reference numeral 62 denotes a cap disposed at a home position adjacent to the blade 61 and which can be moved in a direction perpendicular to the direction of motion of the recording head to cap the discharge orifice surface in contact therewith. Reference numeral 63 denotes an absorber provided adjacent to the blade 61 and held so as to project into the path of motion of the recording head, as is blade 61. The blade 61, the cap 62 and the absorber 63 form a discharge recovery portion 64, and the blade 61 and absorber 63 serve to remove moisture and dust from the ink discharge orifice surface.

Reference numeral 65 denotes a recording head comprising structure for generating discharge energy so that recording is made by discharging an ink onto a cloth located opposite to the discharge orifice surface having discharge orifices, and reference numeral 66 denotes a carriage for mounting the recording head 65 thereon and moving it. The carriage 66 is slidably engaged to a guide shaft 67, a portion of the carriage 66 being connected in a manner not shown to a belt 69 driven by a motor 68. This permits the movement of the carriage 66 along the guide shaft 67 within both the area of recording by the recording head 65 and an area adjacent thereto.

Reference numeral 51 denotes a cloth supply portion for inserting a cloth therein, and reference numeral 52 denotes a cloth feeding roller driven by a motor (not shown). In this construction, a cloth is fed to a position opposite to the discharge orifice surface of the recording head 65, and is moved to a cloth removal portion provided with cloth discharge rollers 53 as the recording progresses.

When the recording head 65 is returned to the home position at the end of recording or the like, the cap 62 of the head recovery portion 64 is retracted from the path of motion of the recording head 65, but the blade 61 is projected into the movement path. As a result, the discharge orifice surface of the recording head 65 is wiped by the blade 61. When the discharge orifice surface of the recording head 65 is capped by the cap 62 in contact therewith, the cap 62 is moved so as to project into the path of motion of the recording head 65.

When the recording head 65 is moved to a recording start portion from the home position, the cap 62 and the blade 61 are at the same position as the wiping position. Consequently, the discharge orifice surface of the recording head 65 is also wiped with the blade 61 during this movement to the recording start position.

The recording head is not only moved to the home position at the times that recording ends and discharge recovery is performed, but also is moved to the home position adjacent to the recording area at predetermined intervals during the time the recording head is moved for recording within the recording area. The discharge orifice surface of the recording head 65 is wiped during this movement to the home position.

Figure 5:
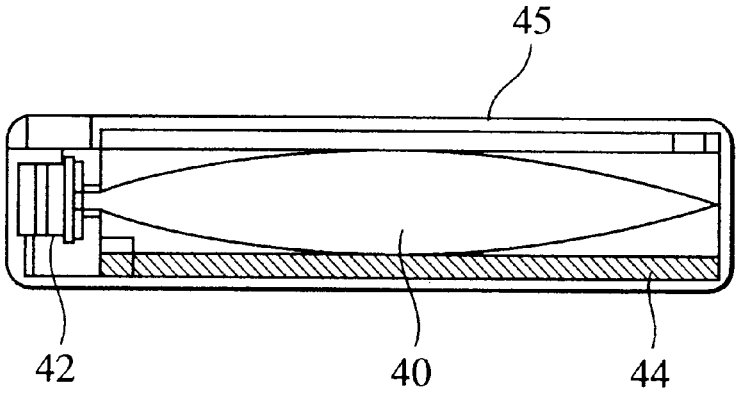
FIG. 5 is a side cross-sectional view showing an ink cartridge.

FIG. 5 is a drawing showing an example of an ink cartridge containing an ink to be supplied through an ink supply member, e.g., a tube. In FIG. 5, reference numeral 40 denotes an ink containing portion, for example, an ink bag, for containing a supply of ink, a rubber stopper 42 being provided at one end thereof. A needle (not shown) is inserted into the stopper 42 so that the ink contained in the ink bag 40 can be supplied to the head. Reference numeral 44 denotes an absorber for receiving waste ink. It is preferable for the present invention that the ink contact surface of the ink containing portion consists of polyolefin, particularly polyethylene. In addition to the above-described apparatus in which the head and the ink cartridge are separately provided can be used in the ink-jet recording apparatus of the present invention, an apparatus in which the head and the ink cartridge are integrated, as shown in FIG. 6, also can preferably be used.

Figure 6:
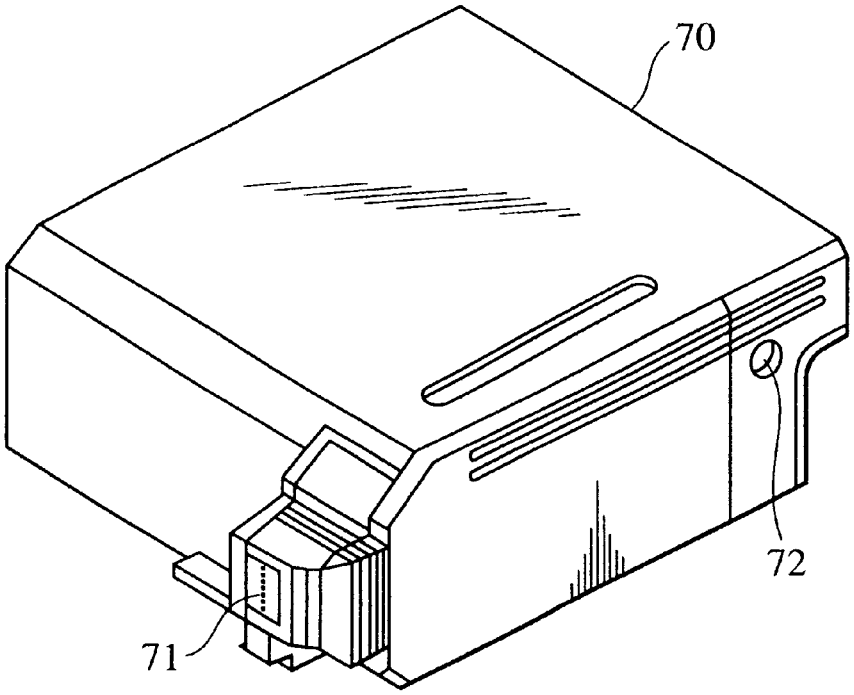
FIG. 6 is a perspective view showing a recording unit.

In FIG. 6, reference numeral 70 denotes a recording unit comprising an ink containing portion, for example, an ink absorber, for containing ink therein, so that the ink in the ink absorber is discharged as ink droplets from a head portion 71 having a plurality of orifices. It is preferable for the present invention to use polyurethane as a material for the ink absorber. Reference numeral 72 denotes a vent hole for allowing the inside of the recording unit 70 to communicate with the atmosphere. The recording unit 70 is used in place of the recording head shown in FIG. 4, and is detachable from the carriage 66.

When the printing ink used in the present invention is applied to a cloth as described above, the ink merely adheres to the cloth in this state. It is then necessary to first fix the dyes to fibers by reaction, and then remove unfixed dyes from the cloth. In the reactive fixing step, when a HT (High Temperature) steaming method or a thermosol method is used as the fixing method, the effects of the invention become remarkable. The HT steaming method is preferably carried out by treatment at 140 to 190° C. for 2 to 30 minutes, and more preferably at 160 to 180° C. for 6 to 8 minutes. The thermosol method is preferably performed by treatment at 160 to 210° C. for 10 seconds to 5 minutes, and more preferably at 180 to 210° C. for 20 seconds to 2 minutes. The removal of unfixed dyes may be performed using any conventional known method, but reduction washing is particularly preferred.

The cloth subjected to the above treatment is cut to a desired size, and is then subjected to steps of sewing, bonding or welding for obtaining final processed articles to provide items such as clothes, for example, one-piece dresses, dresses, neckties, swimming suits, etc.; bed covers; sofa covers; handkerchiefs; and curtains. Many processing methods of sewing cloth in clothes or other daily necessaries are described in known books such as "Latest Knit Sewing Manual" (issued by Seni Journal Co.), the Monthly Magazine "Soen" (issued by Bunka Shuppankyoku), etc.

EXAMPLES

The present invention is described in further detail below with reference to examples and comparative examples. In the description below, "parts" and "%" are "parts by weight" and "% by weight", respectively, unless otherwise provided.

Example 1

Formation of Cloth (A)

A plain cloth comprising polyester yarns having an average size of 40 deniers and comprising polyester filament fibers having an average size of 2 deniers was previously immersed in an aqueous 10% urea solution, dehydrated with a squeezing percentage of 60%, and then dried to adjust the moisture regain of the cloth to 7%.

Formation of Disperse Dye Solutions (I–IV)

| β-naphthalenesulfonic acid formaldehyde | |
|---|---|
| condensation product | parts |
| Ion-exchanged water | 55 parts |
| Diethylene glycol | 10 parts |

The above components were mixed, and 15 parts of each of the disperse dyes below was further added to the resultant solution, followed by pre-mixing for 30 minutes, and then dispersion treatment under the conditions below.

| | |
|---|---|
| Disperse dyes: | C.I. Disperse Yellow 198 (for disperse dye solution I) C.I. Disperse Red 152 (for disperse dye solution II) C.I. Disperse Blue 165 (for disperse dye solution III) C.I. Disperse Blue 79 (for disperse dye solution IV) |
| Dispersion machine: | Sand grinder (produced by Igarashi Kikai) |
| Grinding medium: | zirconium beads of 1 mm in diameter |
| Packing of grinding medium: | 50% (by volume) |
| Rotational speed: | 1500 rpm |
| Grinding time: | 3 hours |

Each of the resultant solutions was filtered using a Fluoro Porefilter FP-250 (produced by Sumitomo Denko Co., Ltd.) for removing coarse particles to obtain disperse dye solutions (I to IV).

Production of Ink (a)

| | | |
|---|---|---|
| The above disperse dye solution (I) | 10 | parts |
| The above disperse dye solution (IV) | 30 | parts |
| Thiodiglycol | 24 | parts |
| Diethylene glycol | 11 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 25 | parts |

All of the above components were mixed, and the resultant mixture was adjusted to pH 8 with sodium hydroxide, agitated for 2 hours and then filtered with a Fluoro Porefilter FP-100 (trade name, produced by Sumitomo Denko) to obtain ink (a).

Production of Ink (b)

| | | |
|---|---|---|
| The above disperse dye solution (II) | 30 | parts |
| Thiodiglycol | 15 | parts |
| Diethylene glycol | 10 | parts |
| Tetraethylene glycol dimethyl ether | 5 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 40 | parts |

All of the above components were mixed, and the resultant mixture was adjusted to pH 8 with sodium hydroxide, agitated for 2 hours and then filtered using a Fluoro Porefilter FP-100 (trade name, produced by Sumitomo Denko) to obtain ink (b).

Production of Ink (c)

| | | |
|---|---|---|
| The above disperse dye solution (III) | 50 | parts |
| Thiodiglycol | 20 | parts |
| Diethylene glycol | 5 | parts |
| Triethylene glycol | 10 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 15 | parts |

All of the above components were mixed, and the resultant mixture was adjusted to pH 8 with sodium hydroxide, agitated for 2 hours and then filtered with a Fluoro Porefilter FP-100 (trade name, produced by Sumitomo Denko) to obtain ink (c).

The thus-obtained inks (a) to (c) were loaded into a Color Bubble Jet Printer BJC600 (trade name, produced by Canon), and gradation printing was performed on cloth (A) with a printing density of each ink of 0 to 100% and a printing density of three-color mixture of 0 to 300% to form a sample. The sample was then subjected to fixing by steaming treatment at 180° C. for 6 to 8 minutes, water washing and reduction washing. Thereafter, the hue, density and coloring stability of the dyed article were evaluated. The results obtained are shown in Table 1. As can be seen in Table 1, the hue stability of gradation and the coloring stability were good, and a deep color could be obtained. The hues of a solid print portion containing 100% ink (a) and a color mixture portion containing three color inks had chroma $C^* (=((a^*)^2+(b^*)^2)^{1/2})$ of 7 or less.

Example 2

Formation of Disperse Dye Solutions (V–VIII)

| | |
|---|---|
| Sodium lignin sulfonate | 15 parts |
| Ion-exchanged water | 55 parts |
| Diethylene glycol | 15 parts |

The above components were mixed, and each of the disperse dye solutions below was added to the resultant solution, followed by pre-mixing for 30 minutes and dispersion treatment under the following conditions:

| | |
|---|---|
| Disperse dyes: | C.I. Disperse Yellow 224 (for disperse dye solution V) C.I. Disperse Red 88 (for disperse dye solution VI) C.I. Disperse Red 92 (for disperse dye solution VII) C.I. Disperse Blue 214 (for disperse dye solution VIII) |
| Dispersion machine: | Sand grinder (produced by Igarashi Kikai) |
| Grinding medium: | glass beads of 0.5 mm in diameter |
| Packing of grinding medium: | 70% (by volume) |
| Rotational speed: | 1500 rpm |
| Grinding time: | 3 hours |

Each of the resultant solutions was filtered using a Fluoro Porefilter FP-250 (produced by Sumitomo Denko Co., Ltd.) for removing coarse particles to obtain disperse dye solutions (V to VIII).

Production of Ink (d)

| | | |
|---|---|---|
| The above disperse dye solution (V) | 30 | parts |
| Thiodiglycol | 19 | parts |
| Diethylene glycol | 11 | parts |
| Isopropyl alcohol | 5 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 25 | parts |

All of the above components were mixed, and the resultant mixture was adjusted to pH 8 with sodium hydroxide, agitated for 2 hours and then filtered with a Fluoro Porefilter FP-100 (trade name, produced by Sumitomo Denko) to obtain ink (d).

Production of Ink (e)

| | | |
|---|---|---|
| The above disperse dye solution (VI) | 30 | parts |
| Thiodiglycol | 20 | parts |
| Diethylene glycol | 10 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 40 | parts |

All of the above components were mixed, and the resultant mixture was adjusted to pH 8 with sodium hydroxide, agitated for 2 hours and then filtered using a Fluoro Porefilter FP-100 (trade name, produced by Sumitomo Denko) to obtain ink (e).

Production of Ink (f)

| | | |
|---|---|---|
| The above disperse dye solution (VII) | 15 | parts |
| The above disperse dye solution (VIII) | 35 | parts |
| Thiodiglycol | 20 | parts |
| Diethylene glycol | 5 | parts |
| Triethylene glycol | 10 | parts |
| Sodium metasilicate | 0.0005 | part |
| Iron sulfate | 0.001 | part |
| Nickel chloride | 0.0003 | part |
| Zinc sulfate | 0.003 | part |
| Calcium chloride | 0.002 | part |
| Ion-exchanged water | 15 | parts |

All of the above components were mixed, and the resultant mixture was adjusted to pH 8 with sodium hydroxide, agitated for 2 hours and then filtered in a Fluoro Porefilter FP-100 (trade name, produced by Sumitomo Denko) to obtain ink (f).

Printing was carried out on the same cloth as that used in Example 1 by the same method using the thus-obtained inks (d) to (f), followed by steaming treatment at 180° C. for 6 to 8 minutes, and water washing and reduction washing. Thereafter, the hue, density and coloring stability of the dyed articles were evaluated. The results obtained are shown in Table 1. As can be seen in Table 1, the hue stability of gradation and the coloring stability were good, and a deep color could be obtained. The hues of a solid print portion containing 100% ink (f) and a color mixture portion containing three color inks had chroma C* $(=((a^*)^2+(b^*)^2)^{1/2})$ of 8 or less.

Example 3

Formation of Cloth (B)

A plain cloth comprising polyester yarns having an average size of 70 deniers and comprising polyester filament fibers having an average size of 0.7 denier was first immersed in an aqueous solution of 1% carboxymethyl cellulose, dehydrated with a squeezing percentage of 60%, and then dried to adjust the moisture regain of the cloth to 10%.

Formation of Disperse Dye Solutions (IX–XII)

| | |
|---|---|
| Sodium polyoxyethylene alkyl ether sulfate | 5 parts |
| β-naphthalenesulfonic acid formaldehyde condensation product | 10 parts |
| Ion-exchanged water | 55 parts |
| Ethylene glycol | 20 parts |

The above components were mixed, and 10 parts of each of the disperse dyes below were further added to the resultant solution, followed by pre-mixing for 30 minutes, and then dispersion treatment under the conditions below.

| | |
|---|---|
| Disperse dyes: | C.I. Disperse Yellow 211 (for disperse dye solution IX) C.I. Disperse Red 86 (for disperse dye solution X) C.I. Disperse Blue 183 (for disperse dye solution XI) C.I. Disperse Blue 79:1 (for disperse dye solution XII) |
| Dispersion machine: | Sand grinder (produced by Igarashi Kikai) |
| Grinding medium: | glass beads of 1 mm in diameter |
| Packing of grinding medium: | 50% (by volume) |
| Rotational speed: | 1500 rpm |
| Grinding time: | 3 hours |

Each of the resultant solutions was filtered with a Fluoro Porefilter FP-250 (produced by Sumitomo Denko Co., Ltd.) for removing coarse particles to obtain disperse dye solutions (IX to XII).

Production of Ink (g)

| | | |
|---|---|---|
| The above disperse dye solution (IX) | 30 | parts |
| Thiodiglycol | 24 | parts |
| Diethylene glycol | 11 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 35 | parts |

All of the above components were mixed, and the resultant mixture was adjusted to pH 8 with sodium hydroxide, agitated for 2 hours and then filtered using a Fluoro Porefilter FP-100 (trade name, produced by Sumitomo Denko) to obtain ink (g).

Production of Ink (h)

| | | |
|---|---|---|
| The above disperse dye solution (X) | 15 | parts |
| The above disperse dye solution (XII) | 20 | parts |
| Thiodiglycol | 20 | parts |
| Diethylene glycol | 10 | parts |
| Sodium metasilicate | 0.0005 | part |
| Iron sulfate | 0.001 | part |

-continued

| | | |
|---|---|---|
| Nickel chloride | 0.0003 | part |
| Zinc sulfate | 0.0003 | part |
| Calcium chloride | 0.002 | part |
| Ion-exchanged water | 35 | parts |

All of the above components were mixed, and the resultant mixture was adjusted to pH 8 with sodium hydroxide, agitated for 2 hours and then filtered in a Fluoro Porefilter FP-100 (trade name, produced by Sumitomo Denko) to obtain ink (h).

Production of Ink (i)

| | | |
|---|---|---|
| The above disperse dye solution (XI) | 45 | parts |
| Thiodiglycol | 20 | parts |
| Diethylene glycol | 5 | parts |
| Triethylene glycol | 10 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 20 | parts |

All of the above components were mixed, and the resultant mixture was adjusted to pH 8 with sodium hydroxide, agitated for 2 hours and then filtered using a Fluoro Porefilter FP-100 (trade name, produced by Sumitomo Denko) to obtain ink (i).

Printing was made on the above cloth (B) by the same method as described above using the thus-obtained inks (g) to (i), followed by steaming treatment at 180° C. for 6 to 8 minutes, and water washing and reduction washing. Thereafter, the hue, density and coloring stability of the dyed article were evaluated. The results obtained are shown in Table 1. As is clear from Table 1, the hue stability of gradation and the coloring stability were good, and a deep color could be obtained. The hues of a solid print portion containing 100% ink (h) and a color mixture portion containing three color inks had chroma C* $(=((a^*)^2+(b^*)^2)^{1/2})$ of 7 or less.

Example 4

Printing was carried out using the same cloth (A) used in Example 1 by the same method as described above using the inks (a), (b) and (f) used in Examples 1 and 2, followed by thermosol treatment at 200° C. for 40 to 50 seconds, and water washing and reduction washing. Thereafter, the hue, density and coloring stability of the dyed article were evaluated. The results obtained are shown in Table 1. As can be seen in Table 1, the hue stability of gradation and the coloring stability were good, and a deep color could be obtained. The hues of a solid print portion containing 100%, ink (a) and a color mixture portion containing three color inks had chroma C* $(=((a^*)^2+(b^*)^2)^{1/2})$ of 7 or less.

Example 5

Production of Ink (j)

| | | |
|---|---|---|
| The above disperse dye solution (I) | 20 | parts |
| The above disperse dye solution (II) | 10 | parts |
| The above disperse dye solution (III) | 20 | parts |
| Thiodiglycol | 20 | parts |
| Diethylene glycol | 5 | parts |

-continued

| | | |
|---|---|---|
| Triethylene glycol | 10 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 15 | parts |

All of the above components were mixed, and the resultant mixture was adjusted to pH 8 with sodium hydroxide, agitated for 2 hours and then filtered using a Fluoro Porefilter FP-100 (trade name, produced by Sumitomo Denko) to obtain ink (j).

Printing was made on the same cloth (A) by the same method as described above using the thus-obtained ink (j) and inks (d) and (e) used in Example 2, followed by steaming treatment at 180° C. for 6 to 8 minutes, and water washing and reduction washing. Thereafter, the hue, density and coloring stability of the dyed article were evaluated. The results obtained are shown in Table 1. As is obvious from Table 1, the hue stability of gradation and the coloring stability were good, and a deep color could be obtained. The hues of a solid print portion containing 100% ink (j) and a color mixture portion containing three color inks had chroma C* $(=((a^*)^2+(b^*)^2)^{1/2})$ of 8 or less.

Comparative Example 1

Production of Ink (k)

| | | |
|---|---|---|
| The above disperse dye solution (I) | 40 | parts |
| Thiodiglycol | 24 | parts |
| Diethylene glycol | 11 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 25 | parts |

All of the above components were mixed, and the resultant mixture was adjusted to pH 8 with sodium hydroxide, agitated for 2 hours and then filtered with a Fluoro Porefilter FP-100 (trade name, produced by Sumitomo Denko) to obtain ink (j).

Printing was performed on the same cloth (A) by the same method as described above using the thus-obtained ink (k) and inks (b) and (c) used in Example 1, followed by steaming treatment at 180° C. for 6 to 8 minutes, and water washing and reduction washing. Thereafter, the hue, density and coloring stability of the dyed article were evaluated. The results obtained are shown in Table 1. The coloring stability was particularly bad, and the density was low, as compared with Example 1.

Comparative Example 2

Gradation printing was performed on cloth (A) of Example 1 using inks (a) and (b) used in Example 1 with a printing density of each ink of 0 to 100% and a printing density of two-color mixtures of 0 to 200% to form a sample. The sample was then subjected to fixing by steaming treatment at 180° C. for 6 to 8 minutes, and water washing and reduction washing. Thereafter, the hue, density and coloring stability of the dyed article were evaluated. The results obtained are shown in Table 1. As is shown in Table 1, the hue stability of gradation and the coloring stability were good, and a deep color could be obtained. The hue stability of gradation and coloring stability deteriorated, and the density was decreased, as compared with Example 1.

Comparative Example 3

Production of Ink (l)

| | | |
|---|---|---|
| The above disperse dye solution (VIII) | 50 | parts |
| Thiodiglycol | 20 | parts |
| Diethylene glycol | 5 | parts |
| Triethylene glycol | 10 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 15 | parts |

All of the above components were mixed, and the resultant mixture was adjusted to pH 8 with sodium hydroxide, agitated for 2 hours and then filtered using a Fluoro Porefilter FP-100 (trade name, produced by Sumitomo Denko) to obtain ink (l).

Printing was performed on the cloth (A) used in Example 2 by the same method as described above using the thus-obtained ink (l) and inks (d) and (e) used in Example 2, followed by steaming treatment at 180° C. for 6 to 8 minutes, and water washing and reduction washing. Thereafter, the hue, density and coloring stability of the dyed article were evaluated. The results obtained are shown in Table 1. The coloring stability was particularly bad, and the density was low, as compared with Example 2.

Comparative Example 4

Gradation printing was performed on cloth (A) of Example 5 using inks (e) and (j) used in Example 5 with a printing density of each ink of 0 to 100% and a printing density of two-color mixtures of 0 to 200% to form a sample. The sample was then subjected to fixing by steaming treatment at 180° C. for 6 to 8 minutes, and water washing and reduction washing. Thereafter, the hue, density and coloring stability of the dyed article were evaluated. The results obtained are shown in Table 1. As is shown in Table 1, the hue stability of gradation and the coloring stability were good, and a deep color could be obtained. The hue stability of gradation and coloring stability deteriorated, as compared with Example 5.

TABLE 1

| | Ink used | Type of dye used | Hue change of gradation*1 | Coloring stability*2 | Maximum attained density*3 |
|---|---|---|---|---|---|
| Example 1 | a<br>b<br>c | DY 198<br>DB 79<br>DR 152<br>DB 165 | A | A | 23.5 |
| Example 2 | d<br>e<br>f | DY 224<br>DR 88<br>DR 92<br>DB 214 | A | A | 22.9 |
| Example 3 | a<br>b<br>c | DY 211<br>DR 86<br>DB 79:1<br>DB 183 | A | A | 24.0 |
| Example 4 | a<br>b<br>f | DY 198<br>DB 79<br>DR 152<br>DR 92<br>DB 214 | A | A | 25.1 |
| Example 5 | d<br>e<br>j | DY 224<br>DR 88<br>DY 198<br>DR 152<br>DB 165 | A | A | 24.9 |
| Comparative Example 1 | k<br>b<br>c | DY 198<br>DR 152<br>DB 165 | B | C | 17.9 |
| Comparative Example 2 | a<br>b | DY 198<br>DB 79<br>DR 152 | C | C | 14.1 |
| Comparative Example 3 | d<br>e<br>l | DY 224<br>DR 88<br>DB 214 | B | C | 18.0 |
| Comparative Example 4 | e<br>j | DR 88<br>DY 198<br>DR 152<br>DB 165 | C | B | 14.7 |

*1:Chromaticity (a*, b*) of each of the resultant gradation print patches was measured by a Minolta Spectrocolorimeter CM-2022, and chroma C* was calculated by the equation below. A hue change was evaluated on the basis of a variation in chroma C*.

Chroma C* $(=((a^*)^2 + (b^*)^2)^{1/2})$

A: C* variation of less than 2

B: C* variation of 2 to 5

C: C* variation of 5 or more

*2:In Examples 1 to 3 and 5, and Comparative Examples 1 to 4, the K/S values below of a sample subjected to steaming treatment for 6 min. and a sample subjected to steaming treatment for 8 min. were measured, and a difference between the measurements was determined. In Example 4, the K/S values of a sample subjected to thermosol treatment for 40 sec. and a sample subjected to thermosol treatment for 50 sec. were measured, and a difference between the measurements was determined.

A: K/S value difference of 1 or less due to a small effect of the difference between the heating conditions B: K/S value difference of 1 to 2 due to some effect of the difference between the heating conditions C: K/S value difference of 2 or more due to a large effect of the difference between the heating conditions $K/S = (1 - R)^2/2R$ R: reflectance at maximum absorption wavelength

*3: The maximum K/S value of a color mixture gradation comprising 2 or 3 inks was measured.

Example 6

Ink-jet textile printing inks (a), (c), (d) and (f) used in Examples 1 and 2 were loaded into a Color Bubble Jet Printer BJC600 (trade name, produced by Canon), and gradation printing was performed on cloth (A) of Example 1 with a printing density of each ink of 0 to 100% and a printing density of a four-color mixture of 0 to 400% to form a sample. The sample was then subjected to steaming treatment at 180° C. for 6 to 8 minutes, and water washing and reduction washing. Thereafter, the hue, density and coloring stability of the dyed article were evaluated. The results obtained are shown in Table 2. As shown in Table 2, the hue stability of gradation and the coloring stability were good, and a deep color could be obtained. The tones of a solid print portion containing 100% ink (f) and a color mixture portion containing four color inks had chroma C* $(=((a^*)^2+(b^*)^2)^{1/2})$ of 6 or less.

Example 7

Formation of Disperse Dye Solutions (XIII–XIV)

| | |
|---|---|
| β-naphthalenesulfonic acid formaldehyde condensation product | 20 parts |
| Ion-exchanged water | 55 parts |
| Diethylene glycol | 10 parts |

The above components were mixed, and 15 parts of each of the disperse dyes below was further added to the resultant solution, followed by pre-mixing for 30 minutes, and then dispersion treatment under the conditions below.

| | |
|---|---|
| Disperse dyes: | C.I. Disperse Blue 60 (for disperse dye solution XIII) C.I. Disperse Violet 77 (for disperse dye solution XIV) |
| Dispersion machine: | Sand grinder (produced by Igarashi Kikai) |
| Grinding medium: | zirconium beads of 1 mm in diameter |
| Packing of grinding medium: | 50% by volume |
| Rotational speed: | 1500 rpm |
| Grinding time: | 3 hours |

Each of the resultant solutions was filtered in a Fluoro Porefilter FP-250 (produced by Sumitomo Denko Co., Ltd.) for removing coarse particles to obtain disperse dye solutions (XIII to XIV).

Production of Ink (m)

| | | |
|---|---|---|
| The above disperse dye solution (XIII) | 40 | parts |
| Thiodiglycol | 24 | parts |
| Diethylene glycol | 11 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 25 | parts |

All of the above components were mixed, and the resultant mixture was adjusted to pH 8 with sodium hydroxide, agitated for 2 hours and then filtered in a Fluoro Porefilter FP-100 (trade name, produced by Sumitomo Denko) to obtain ink-jet textile printing ink (m).

Production of Ink (n)

| | | |
|---|---|---|
| The above disperse dye solution (XII) | 40 | parts |
| Thiodiglycol | 24 | parts |
| Diethylene glycol | 11 | parts |
| Sodium metasilicate | 0.0005 | part |
| Iron sulfate | 0.001 | part |
| Nickel chloride | 0.0003 | part |
| Zinc sulfate | 0.0003 | part |
| Calcium chloride | 0.002 | part |
| Ion-exchanged water | 25 | parts |

All of the above components were mixed, and the resultant mixture was adjusted to pH 8 with sodium hydroxide, agitated for 2 hours and then filtered using a Fluoro Porefilter FP-100 (trade name, produced by Sumitomo Denko) to obtain ink-jet textile printing ink (n).

Six inks including the thus-obtained inks (m) and (n), and ink-jet textile printing inks (a), (b), (d) and (i) used in Examples 1, 2 and 3 were simultaneously loaded into a converted Color Bubble Jet Printer BJC600 (trade name, produced by Canon), and gradation printing was performed on cloth (A) of Example 1 with a printing density of each ink of 0 to 50% and a printing density of a six-color mixture of 0 to 300% to form a sample. The sample was then subjected to steaming treatment at 180° C. for 6 to 8 minutes, and water washing and reduction washing. Thereafter, the hue, density and coloring stability of the dyed article were evaluated. The results obtained are shown in Table 2. As shown in Table 2, the hue stability of gradation and the coloring stability were good, and a deep color could be obtained. The tones of a solid print portion containing 50% ink (a) and a color mixture portion containing six color inks had chroma C* $(=((a^*)^2+(b^*)^2)^{1/2})$ of 6 or less.

TABLE 2

| | Ink used | Type of dye used | Hue change of gradation*1 | Coloring stability*2 | Maximum attained density*3 |
|---|---|---|---|---|---|
| Example 6 | a | DR 152 | A | A | 25.3 |
| | c | DB 165 | | | |
| | d | DY 224 | | | |
| | f | DR 92 | | | |
| | | DB 214 | | | |
| Example 7 | a | DY 198 | A | A | 24.8 |
| | | DB 79 | | | |
| | b | DR 152 | | | |
| | d | DY 224 | | | |
| | i | DB 183 | | | |
| | m | DB 60 | | | |
| | n | DV 77 | | | |

As described above, the textile printing method of the present invention can provide clear prints with a high density, and forms stable images without changes in tone even if the conditions for dyeing treatment by heating are more or less changed.

What is claimed is:

1. A method of printing on a cloth containing fibers employing a disperse dye in an ink-jet process using at least a first color ink, a second color ink, and a third color ink, said inks including a disperse dye, comprising the steps of:

(a) forming a color mixture portion by applying at least said first, said second, and said third color inks to the cloth so that said first, said second, and said third color inks are partly overlapped;

(b) fixing a dye to the cloth by heat treating the cloth on which said color mixture portion is formed; and (c) washing the cloth to remove at least a portion of any of the dye which has not been fixed from the cloth;

wherein said first, said second, and said third color inks contain a total of at least four disperse dyes.

2. A textile printing method according to claim 1, wherein after dying, said color mixture portion on the cloth has a hue of $((a^*)^2+(b^*)^2)^{1/2}<10$, where chromaticity is indicated by a* and b* in accordance with CIE 1976 (L*, a*, b*).

3. A textile printing method according to claim 2, wherein at least one of said inks comprise at least two dyes, and the inks on the cloth after dying has a hue within a range of $((a^*)^2+(b^*)^2)^{1/2}<10$, where chromaticity is indicated by a* and b* in accordance with CIE 1976 (L*, a*, b*).

4. A textile printing method according to claim 1, wherein said heat treating is performed by at least one of a high-temperature steaming (HT streaming) and a thermosol method.

5. A textile printing method according to claim 1, wherein said ink-jet recording process comprises a process for discharging ink by utilizing heat energy.

6. A textile printing method according to claim 1, wherein said cloth comprises at least one substance selected from the group consisting of water-soluble metallic salts, water-soluble polymers, urea, thiourea and surfactants, in an amount of 0.01 to 20% by weight relative to a dye weight of said cloth.

7. A printed textile printed using a method according to that described in claim 1.

8. A processed article obtained by processing the printed textile of claim 7.

9. A processed article obtained by processing at least one piece obtained by cutting a printed textile of claim 7 to a predetermined size.

10. A processed article according to claim 9, wherein said processing comprises sewing.

* * * * *

UNITED STATES PATENT AND TRADEMARK OFFICE

CERTIFICATE OF CORRECTION

PATENT NO. : 5,910,812

DATED : June 8, 1999

INVENTORS : Tomoya Yamamoto, et al.

It is certified that error appears in the above-identified patent and that said Letters Patent is hereby corrected as shown below:

COLUMN 2

Line 11, "ink" should read --inks--.

COLUMN 3

Line 10, "4" should read --four--.

COLUMN 5

Line 63, "is difficult" should be deleted.

COLUMN 6

Line 20, "explanation" should be deleted.

COLUMN 9

Table 1, "product parts" should read
--product 20 parts--.

COLUMN 11

Table 3, "0.003 part" should read --0.0003 part--.

UNITED STATES PATENT AND TRADEMARK OFFICE

CERTIFICATE OF CORRECTION

PATENT NO. : 5,910,812

DATED : June 8, 1999

INVENTORS : Tomoya Yamamoto, et al.

It is certified that error appears in the above-identified patent and that said Letters Patent is hereby corrected as shown below:

COLUMN 18

Line 56, "dying" should read --dyeing--; and
Line 61, "dying" should read --dyeing--.

Signed and Sealed this

Twenty-third Day of November, 1999

*Attest:*

Q. TODD DICKINSON

*Attesting Officer*

*Acting Commissioner of Patents and Trademarks*